US006607441B1

(12) United States Patent
Acres

(10) Patent No.: US 6,607,441 B1
(45) Date of Patent: Aug. 19, 2003

(54) METHOD FOR TRANSFERRING CREDIT FROM ONE GAMING MACHINE TO ANOTHER

(75) Inventor: John F. Acres, Corvallis, OR (US)

(73) Assignee: Acres Gaming Incorporated, Corvallis, OR (US)

( * ) Notice: Subject to any disclaimer, the term of this patent is extended or adjusted under 35 U.S.C. 154(b) by 0 days.

(21) Appl. No.: 09/134,285

(22) Filed: Aug. 14, 1998

Related U.S. Application Data

(60) Provisional application No. 60/083,302, filed on Apr. 28, 1998.

(51) Int. Cl.[7] ..... A63F 9/24
(52) U.S. Cl. ..... 463/25; 463/40
(58) Field of Search ..... 463/25, 26–27, 463/29, 39–42, 16–20

(56) References Cited

U.S. PATENT DOCUMENTS

| | | | | |
|---|---|---|---|---|
| 3,598,964 A | 8/1971 | Dell et al. | ..... | 235/61.6 R |
| 4,072,930 A | 2/1978 | Lucero et al. | ..... | 340/152 T |

(List continued on next page.)

FOREIGN PATENT DOCUMENTS

| | | |
|---|---|---|
| AU | 25946/84 | 10/1984 |
| AU | B-27572/84 | 11/1984 |
| AU | B-53370/86 | 10/1989 |
| AU | B-10488/92 | 7/1992 |
| AU | B-20988/92 | 1/1993 |
| AU | B-71194/91 | 5/1994 |
| AU | A-21618/95 | 1/1996 |
| AU | A-48323/97 | 6/1998 |
| AU | 725692 | 7/1998 |
| AU | 736924 | 8/1998 |
| AU | 748263 | 11/1998 |
| AU | 744026 | 2/1999 |
| AU | 746506 | 2/1999 |
| AU | 738686 | 3/1999 |
| AU | 749222 | 3/1999 |
| AU | 199924992 A1 | 4/1999 |
| AU | 736679 | 5/1999 |
| AU | 736779 | 5/1999 |
| AU | 749286 | 5/1999 |
| AU | 748955 | 1/2000 |
| AU | 746272 | 2/2000 |
| AU | 746764 | 2/2000 |
| AU | 748434 | 2/2000 |

(List continued on next page.)

*Primary Examiner*—Michael O'Neill
(74) *Attorney, Agent, or Firm*—Marger Johnson & McCollom, P.C.

(57) ABSTRACT

A method for transferring credits between gaming devices connected by a network to a host computer comprising. A player account accessible by the host computer is created. The player can access the account by inserting a card into a card reader at one of the gaming devices. A credit is applied by the player to the gaming device, typically by inserting bills into a bill acceptor. The credit and any awards resulting from gaming-device play are stored on a credit meter associated with the gaming device. Access to the account is terminated when the player withdraws the card from the card reader. A player initiates a request to redeem the balance stored on the credit meter by depressing a cash-out button. The balance on the credit meter is transferred to the player account if the cash-out button is pressed before the card is withdrawn, and is paid to the player via the gaming machine if the button is pressed after the card is withdrawn.

37 Claims, 2 Drawing Sheets

U.S. PATENT DOCUMENTS 4,230,265 A 10/1980 Casaly ..... 235/455
4,258,838 A 3/1981 Rockola et al. ..... 194/1 R
4,283,709 A 8/1981 Lucero et al. ..... 340/147 R
4,335,809 A 6/1982 Wain ..... 194/1 R
4,467,424 A 8/1984 Hedges et al. ..... 364/412
4,575,622 A 3/1986 Pellegrini ..... 235/382
4,624,459 A 11/1986 Kaufman ..... 273/143 R
4,636,951 A 1/1987 Harlick ..... 364/412
4,652,998 A 3/1987 Koza et al. ..... 364/412
4,669,596 A 6/1987 Capers et al. ..... 194/210
4,669,730 A 6/1987 Small ..... 273/138 A
4,679,143 A 7/1987 Hagiwara ..... 364/412
4,760,247 A 7/1988 Keane et al. ..... 235/454
4,764,666 A 8/1988 Bergeron ..... 235/380
4,775,937 A 10/1988 Bell ..... 364/412
4,805,907 A 2/1989 Hagiwara ..... 273/138 A
4,815,741 A 3/1989 Small ..... 273/138 A
4,837,728 A 6/1989 Barrie et al. ..... 364/412
4,839,640 A 6/1989 Ozer et al. ..... 340/825.31
4,856,787 A 8/1989 Itkis ..... 273/237
4,880,237 A 11/1989 Kishishita ..... 273/138 A
4,882,473 A 11/1989 Bergeron et al. ..... 235/380
4,926,996 A 5/1990 Eglise et al. ..... 194/212
4,964,638 A 10/1990 Ishida ..... 273/138 A
4,991,848 A 2/1991 Greenwood et al. .... 273/138 R
5,038,022 A 8/1991 Lucero ..... 235/380
5,042,810 A 8/1991 Williams ..... 273/142
5,096,195 A 3/1992 Gimmon ..... 273/138 A
5,103,081 A 4/1992 Fisher et al. ..... 235/464
5,116,055 A 5/1992 Tracy ..... 273/138 A
5,123,649 A 6/1992 Tiberio ..... 273/143 R
5,135,224 A 8/1992 Yamamoto et al. ..... 273/143 R
5,159,549 A 10/1992 Hallman, Jr. et al. ..... 364/412
5,179,517 A 1/1993 Sarbin et al. ..... 364/410
5,197,094 A 3/1993 Tillery et al. ..... 379/91
5,217,224 A 6/1993 Sincock ..... 273/138 A
5,249,800 A 10/1993 Hilgendorf et al. ..... 273/138 A
5,257,179 A 10/1993 DeMar ..... 364/410
5,265,874 A 11/1993 Dickinson et al. ..... 273/138 A
5,275,400 A 1/1994 Weingardt et al. ..... 273/85 CP
5,280,909 A 1/1994 Tracy ..... 273/138 A
5,286,023 A 2/1994 Wood ..... 273/138 A
5,287,269 A 2/1994 Dorrough et al. ..... 364/408
5,290,033 A 3/1994 Bittner et al.
5,292,127 A 3/1994 Kelly et al. ..... 273/138 R
5,321,241 A 6/1994 Craine ..... 235/380
5,326,104 A 7/1994 Pease et al. ..... 273/138 A
5,344,144 A 9/1994 Canon ..... 273/138 A
5,345,379 A 9/1994 Brous et al. ..... 364/140
5,370,306 A 12/1994 Schulze et al. ..... 273/138 A
5,371,345 A 12/1994 LeStrange et al. ..... 235/380
5,429,361 A 7/1995 Raven et al. ..... 273/138 A
5,470,079 A 11/1995 LeStrange et al. ..... 273/138 A
5,472,194 A 12/1995 Breeding et al. ..... 273/138 A
5,473,144 A 12/1995 Mathurin, Jr. ..... 235/380
5,477,040 A 12/1995 Lalonde ..... 235/379
5,494,287 A 2/1996 Manz ..... 273/143 R
5,533,727 A 7/1996 DeMar ..... 463/23
5,536,016 A 7/1996 Thompson ..... 273/269
5,559,312 A 9/1996 Lucero ..... 235/380
5,564,700 A 10/1996 Celona ..... 463/27
5,577,959 A 11/1996 Takemoto et al. ..... 463/25
5,580,309 A 12/1996 Piechowiak et al. ..... 463/16
5,580,310 A 12/1996 Orus et al. ..... 763/16
5,586,936 A 12/1996 Bennett et al. ..... 463/25
5,586,937 A 12/1996 Menashe ..... 463/41
5,611,730 A 3/1997 Weiss ..... 463/20
5,655,961 A * 8/1997 Acres et al. ..... 463/27
5,674,128 A 10/1997 Holch et al. ..... 463/42
5,702,304 A 12/1997 Acres et al. ..... 463/29
5,722,891 A 3/1998 Inoue ..... 463/20
5,741,183 A 4/1998 Acres et al. ..... 463/42
5,743,523 A 4/1998 Kelly et al. ..... 273/138.1
5,752,882 A 5/1998 Acres et al. ..... 463/42
5,758,875 A 6/1998 Giacalone, Jr. ..... 273/143 R
5,761,647 A 6/1998 Boushy ..... 705/10
5,766,076 A 6/1998 Pease et al. ..... 463/27
5,770,533 A 6/1998 Franchi ..... 463/42
5,811,772 A 9/1998 Lucero ..... 235/380
5,816,917 A 10/1998 Kelmer et al. ..... 463/16
5,816,918 A 10/1998 Kelly et al. ..... 463/16
5,820,459 A 10/1998 Acres et al. ..... 463/25
5,833,540 A 11/1998 Miodunski et al. ..... 463/42
5,836,817 A 11/1998 Acres et al. ..... 463/26
5,839,956 A 11/1998 Takemoto ..... 463/25
5,851,148 A 12/1998 Brune et al. ..... 463/25
5,851,149 A 12/1998 Xidos et al. ..... 463/42
5,854,542 A 12/1998 Forbes ..... 315/291
5,902,983 A 5/1999 Crevelt et al. ..... 235/380
5,919,091 A 7/1999 Bell et al. ..... 463/25
5,967,896 A 10/1999 Jorasch et al.
6,001,016 A 12/1999 Walker et al.
6,012,982 A 1/2000 Piechowiak ..... 463/16
6,012,983 A * 1/2000 Walker et al. ..... 463/20
6,039,648 A 3/2000 Guinn et al. ..... 463/16
6,048,269 A 4/2000 Burns et al. ..... 315/291
6,077,162 A 6/2000 Weiss ..... 463/26
6,089,982 A 7/2000 Holch et al.
6,110,042 A 8/2000 Walker et al.
6,116,041 A * 8/2000 Walker et al. ..... 463/20
6,168,522 B1 * 1/2001 Walker et al. ..... 463/25
6,190,256 B1 2/2001 Walker et al.
6,193,608 B1 2/2001 Walker et al.
6,224,486 B1 5/2001 Walker et al.
6,227,972 B1 5/2001 Walker et al.
6,244,958 B1 6/2001 Acres
6,257,981 B1 7/2001 Acres et al.
6,280,326 B1 8/2001 Saunders
6,280,328 B1 8/2001 Holch et al.
6,302,793 B1 10/2001 Fertitta, III et al.
6,319,125 B1 11/2001 Acres
6,471,590 B2 10/2002 Saunders

FOREIGN PATENT DOCUMENTS

AU 2001100031 A4 5/2001
AU 748694 6/2001
AU 2001100267 A4 8/2001
AU 2001100464 B9 10/2001
AU 2001100644 B9 12/2001
EP 0805424 A2 1/1997
EP 0805424 A3 5/1997
GB 2 211 975 A 7/1989
WO WO 94/12256 6/1994
WO WO 95/22811 8/1995
WO WO96/34345 10/1996
WO WO 98/35309 8/1998
WO WO 98/40140 9/1998
WO WO99/51313 10/1999

* cited by examiner

METHOD FOR TRANSFERRING CREDIT FROM ONE GAMING MACHINE TO ANOTHER

This application claims the benefit of U.S. Provisional Application No. 60/083,302, filed on Apr. 28, 1998.

BACKGROUND OF THE INVENTION

1. Field of the Invention

The present invention relates to a method of accounting for player's wagers, jackpots, and awards on a network of gaming machines, and more particularly to such a method that facilitates transfer of credits from one machine to another.

2. Description of the Related Art

There are several prior art systems implementing cashless gaming on electronic gaming devices, such as slot machines, that are connected to a host computer via a network. Such systems typically require a player to open a cashless-gaming account with the casino prior to playing. The player must appear before a casino cashier who creates a player record on the host computer, receives an initial deposit from the player, and enters the deposit as a credit in the player account. The cashier also issues a cashless-wagering card to the player, who is now ready to begin cashless gaming.

The player selects a slot machine on the casino floor and inserts his or her card into a card reader associated with the slot machine. Each of the other slot machines also include associated card readers. Most prior art systems incorporate a security feature, such as a personal identification number (PIN), that must be satisfied before the system permits the player to draw on the credit in the account. In these prior art systems, the player enters his or her PIN on a keypad associated with the slot machine and card reader after insertion of the card. When the security feature is satisfied, the amount in the player's account appears on the display associated with the slot machine. The player may then draw on the account by initiating commands at the slot machine that transfer credits from the account to the slot machine. As the player transfers money from the account to the slot machine, the credit in the account decreases. If the player should be the recipient of a jackpot or other award at the slot machine, the conventional credit meter on the slot machine increments to add the jackpot or award to the balance on the credit meter.

When the player concludes playing, the balance is transferred from the credit meter to the player's cashless-wagering account responsive to a command initiated by the player. The player then withdraws his or her card and leaves the balance in the account for placing wagers on one of the slot machines at a future time, which may be a few hours, a few days, or longer.

There are a number of disadvantages associated with prior art cashless wagering systems. First, they require casino personnel to receive payments from players to establish the account. Second, the system must generate and store extensive accounting records of the withdrawals and deposits for each player's account. Because players may return after long absences to wager the balance in the account, records of all transactions relating to the account must be maintained indefinitely. Third, because the casino may be holding money for long periods, security measures such as PINs and the like must be implemented. Finally, some systems that permit use of automated teller machines (ATMs) or credit cards to place money on account with the casino require transaction fees, subject the casino to electronic banking laws, and open possibilities for fraud.

It would be desirable to implement a system that would permit players to transfer credits from one machine to another without the disadvantages associated with prior art cashless gaming systems.

SUMMARY OF THE INVENTION

The present invention comprises a method for transferring credits between gaming devices connected by a network to a host computer. A first command initiated by a player at one of the gaming devices provides access to a player account. A credit applied by the player to the gaming device and any awards resulting from gaming-device play are stored on a credit meter associated with the gaming device. Access to the account is terminated responsive to a second command initiated by the player. If the player initiates A request to redeem the balance stored on the credit meter before the second command, the balance is transferred to the player account. If the request occurs after the second command, the balance on the credit meter is paid to the player via the gaming machine.

It is a general object of the present invention to provide a method for transferring credit from one gaming machine to another that overcomes disadvantages associated with prior art cashless gaming systems.

It is another object of the present invention to provide such a method that can be implemented by the player at one of the gaming machines.

It is another object of the present invention to provide such a method that reduces casino overhead related to filling gaming machine hoppers and dealing with cashless wagering accounts.

It is another object of the present invention to provide such a method that facilitates payment of jackpots that exceed the maximum amount payable from the gaming machine hopper.

These and other objects and advantages of the present invention will become more fully apparent when considered in view of the following detailed description of the invention and accompanying drawings wherein:

DETAILED DESCRIPTION OF THE PREFERRED EMBODIMENT

Figure 1:
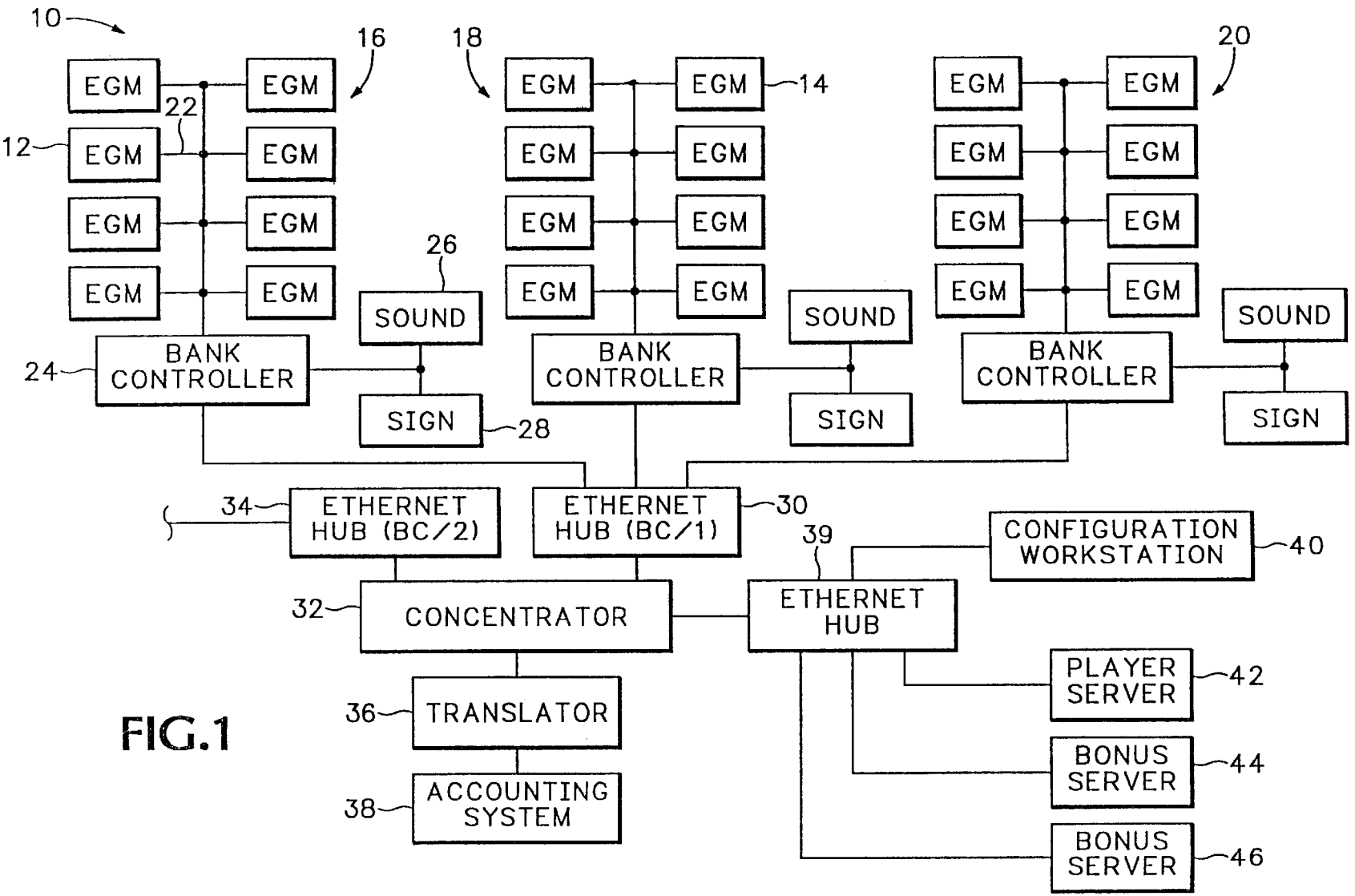
FIG. 1 is a schematic diagram of a plurality of electronic gaming machines interconnected by a computer network to a host computer in accordance with the present invention.

Turning now to FIG. 1, indicated generally at 10 is a schematic diagram illustrating electronic gaming machines (EGMs), like EGMs 12, 14, interconnected by a computer network. In the present embodiment, the EGM comprises a slot machine. Included in the network are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a user interface. It comprises a personal computer including a keyboard, Intel Pentium Processor and Ethernet card.

The player server 42 comprises a microcomputer that is used to control messages that appear on displays associated with each EGM. Player server 42 includes an Intel Pentium Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to link to groups of EGMs operating in a progressive jackpot mode. Examples of bonuses that can be implemented on the network are disclosed in co-pending application Ser. No. 08/843,411, filed Apr. 15, 1997, U.S. Pat. No. 6,319,125 and assigned to the Assignee of the present application (the '411 application), which is incorporated herein by reference for all purposes. This co-pending application also describes in more detail features of the network, like that shown in FIG. 1, that may be used to implement the present invention. Also incorporated herein by reference for all purposes is U.S. Pat. No. 5,655,961, assigned to the Assignee of the present application (the '961 patent), which also discloses bonuses that can be implemented by bonus servers 44, 46 and a network that could be used to implement the present invention.

Figure 2:
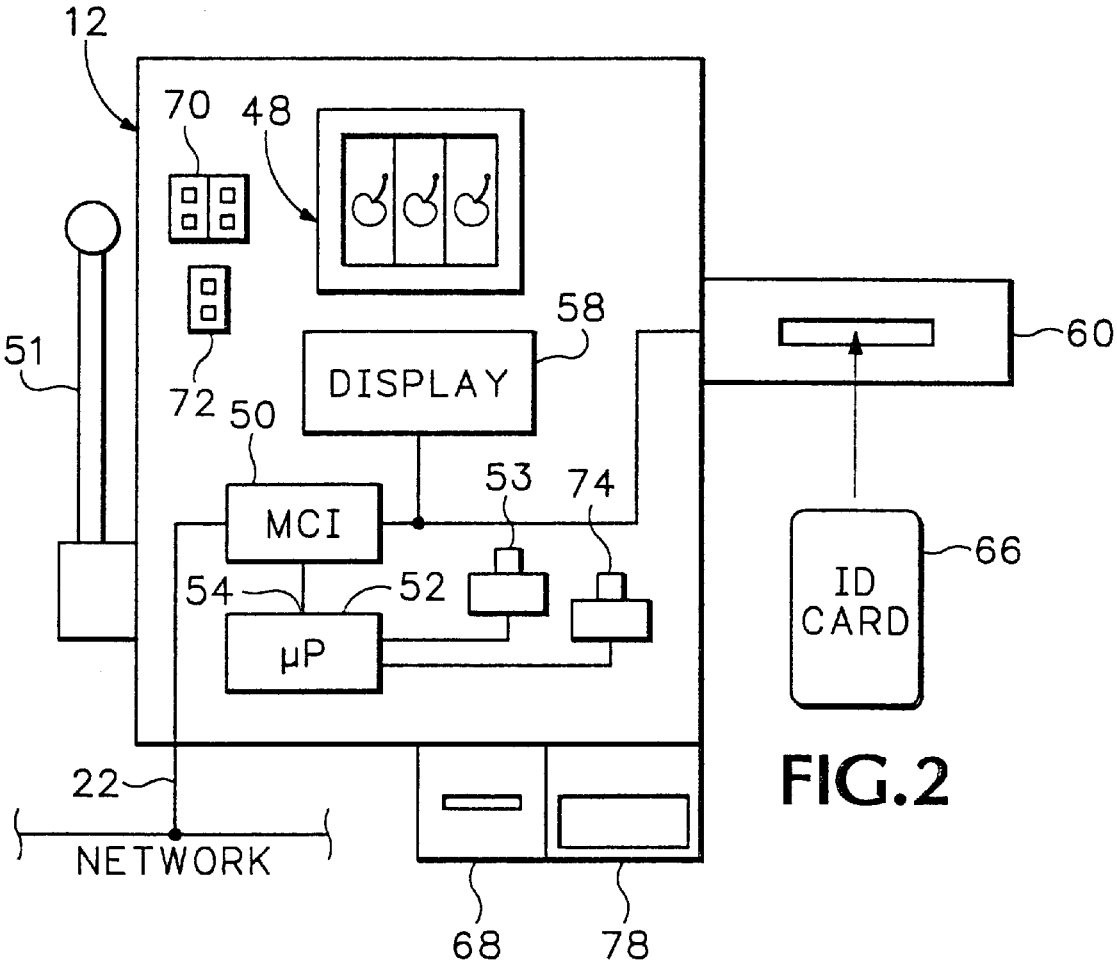
FIG. 2 is a schematic diagram of a slot machine and associated hardware implemented in accordance with the present invention.

FIG. 2 is a highly schematic representation of an electronic slot machine, which is typical of each of the machines in the network, and which incorporates network communications hardware as described hereinafter. This hardware is described in the '961 patent, and is referred to therein as a data communications node. Preferably the network communications hardware is like that disclosed in the '411 application, namely a machine communication interface (MCI) 50. MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made.

MCI 50 may include a random access memory (RAM), which can be used as later described herein. The MCI also facilitates communication between the network and a vacuum florescent display (VFD) 58, and a card reader 60.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor (not shown) that may also be used by the player to make a wager. A credit meter 70 is a numeric display that indicates the total number of credits available for the player to wager. The credits are in the base denomination of the machine. For example, in a nickel slot machine, when a five dollar bill is inserted into bill acceptor 68, a credit of 100 appears on credit meter 70. To place a wager, the player depresses a coin-in button (not shown), which transfers a credit from the credit meter 70 to a coin-in meter 72. Each time the button is depressed a single credit transfers to the coin-in meter up to a maximum bet that can be placed on a single play of the machine. Alternatively, a maximum-bet button (also not shown) is provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating a game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Typical slot machines, like machine 12, are limited in the total amount of coins that can be paid to the player from the hopper. Thus, when jackpots are in excess of the hopper-pay limit, the machine locks up and the jackpot is hand paid by casino personnel to the player. After the jackpot is so paid, the casino personnel resets the machine to permit play to resume.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '411 application. Briefly summarizing such a system, a player registers with the casino prior to commencing gaming. The casino issues a unique player-tracking card to the player and opens a corresponding player account that is stored on accounting system 38 (in FIG. 1). The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

When the casino opens a player account, it may implement a coinless transfer feature in accordance with the present invention. When the account is so flagged by the casino, play may proceed as follows.

The player selects one of the network slot machines—in this case machine 12—and inserts card 66 into reader 60. The player then inserts one or more bills into bill acceptor 68, which purchases a corresponding number of credits in the base denomination of the machine that are applied to and appear on credit meter 70. The player may also, of course, apply credits to the credit meter by depositing coin in the coin acceptor (not shown) that is part of machine 12. When the player inserts card 66 into reader 60, the player record that the casino created on accounting system 38 is fetched from the accounting system and loaded into memory in MCI 50. Insertion of card 66 into card reader 60 is referred to herein as a first command or a log-in command.

After the credits are displayed on meter 70, the player plays slot machine 12 in a conventional manner as described above. That is, the coin-in button (not shown) is depressed by the player to transfer the desired number of credits from credit meter 70 to coin-in meter 72. After so doing, the player presses spin button 53 to spin reels 48. Upon completion of the game, i.e., after the reels stop spinning, any jackpot payable according to a pay table internal to machine 12 is also applied to credit meter 70. Similarly, any bonuses, i.e., any payments to the player that result from awards not generated by the pay table in machine 12, as described in the '961 patent, are also applied to credit meter 70.

When the player concludes play on machine 12, he or she has two options for redeeming any balance remaining on credit meter 70. First, if cash-out button 74 is depressed while card 66 is received in card reader 60, the credits on meter 70 are transferred to the player account record contained in the RAM in MCI 50. Credit meter 60 then reads 0 credits, and the number of credits displayed on meter 70 when cash-out button 74 is depressed is associated with the player record in the RAM of MCI 50. As soon as this transfer occurs, display 58 indicates the amount transferred to the player. After the transfer to the RAM in MCI 50, the player record and associated credits is transferred via connection 22 over the network to the host computer. The term host computer as used herein may refer to a processor, a controller, or memory, which may be located anywhere, including multiple locations, on the network. In the present case, the host computer includes a dedicated storage area on player server 42. The information stored includes the amount, dollar amount, time that storage occurred and the machine number from which the credit was stored, all of which is associated with the identifying player record. Other data associated with the player record, such as the amounts wagered and won, is stored on accounting system 38 in accordance with prior art player tracking systems. Typically the player leaves the card in the card reader from beginning to end of play. This allows the player to be credited for points that can be redeemed for awards. It should be noted, however, that to effect the coinless transfer feature, the card need only be inserted when cash-out button 74 is depressed. In other words, the card need not necessarily be in the card reader during play—the record can be fetched and the credits stored in the player account after all play is complete.

Alternatively, when the player concludes gaming on machine 12, he or she may choose to receive payment via hopper 78 at the machine. If so, the player withdraws card 66 from reader 60 before pressing cash-out button 74. Withdrawal of card 66 from card reader 60 is referred to herein as a second command or a log-out command. Because credits remain on credit meter 70, the player record in RAM of MCI 50 indicates 0 credits, which is stored to the host computer as described above with the player record. The player now depresses cash-out button 74 thus causing the machine to pay credits from meter 70 to hopper 78 in the usual fashion. Depressing cash-out button 74 is referred to herein as a request to redeem the balance stored on the credit meter.

Each slot machine includes conventional controls for setting a maximum amount payable from the hopper of the machine based upon the hoppers capacity and the casino's wishes. In addition, a maximum amount payable at hopper 78 may also be set by the casino at configuration workstation 40 to prevent a player from cashing out credits over a predetermined maximum value. If either value—the value set at the machine or the value set at the workstation—is exceeded, machine 12 locks up in the same fashion as if it had won a jackpot that exceeded the maximum amount payable from the machine hopper.

When a player elects to cash out by storing his or her balance with their player record on the host computer as described above, the player may use the card to transfer the credit to another slot machine on the network. To do so, the player moves to another machine, perhaps after taking a short break, and inserts his or her card 66 into the card reader, like card reader 60, associated with the new slot machine. The MCI, like MCI 50, at the new machine detects insertion of the card. The appropriate player record is called from the host computer, including the record stored on bonus server 44 having the amount of credits stored in the player's account. That record and the associated credits are stored initially in the RAM of MCI 50. The number of credits associated with the record is then transferred to the credit meter of the new machine without any further action on the part of the player. Play then continues as described above, including cashing out by either restoring the balance on the credit meter with his or her account on the host computer or withdrawing the card and cashing out to obtain payment via the machine hopper.

In another embodiment of the present invention, the coinless transfer feature may be implemented without requiring a player to deal with casino personnel. In this embodiment, the player account is anonymous, and is created by the player. In this embodiment, the casino provides an automated card dispenser, each card being coded with an anonymous player account that exists on the host computer. The player simply takes one of the cards from the dispenser and uses it to play as described above. The player has the same options to cash out, namely depressing cash-out button 74 with the card withdrawn to receive coin at the machine and depressing the cash-out button with the card inserted to apply the machine credits to his or her anonymous account in the same manner as described above for an account associated with an identified player. In the latter instance, when the player wishes to resume play, they merely insert the card into the card reader associated with the selected slot machine and credits are applied to the credit meter of the slot machine as described above. The player can also cash out by presenting the card to the cashier, also as described above. The anonymous coinless transfer system is advantageous in that casino personnel are not required to activate the coinless transfer feature.

In another aspect, the present invention limits the time between storing credits to a player's account, whether anonymous or not, and accessing the account to resume play with credits in the account. In this aspect, the host computer initiates a timed count when the player withdraws his or her card from the card reader. The casino may select—at configuration workstation 40—a maximum time, for example, 2 hours, that the player may access the account using a card reader. If this time is exceeded, the credits will not transfer from the account to the credit meter of the slot machine when the card is inserted. The player must therefore present the card to a casino cashier who can access the account using a card reader and reimburse the player with the total amount credited to his or her account. This feature reduces potential casino liability by not permitting card access to deposited credits for extended periods.

What is claimed is:

1. A method for transferring credits between gaming devices connected by a network to a host computer comprising:

creating a player account accessible by the host computer;

providing access to the account responsive to a first command initiated by a player at one of the gaming devices;

detecting a credit applied by the player to said one gaming device;

storing the credit and any awards resulting from gaming-device play on a credit meter associated with said one gaming device;

terminating access to the account responsive to a second command initiated by the player;

detecting a player-initiated request to redeem the balance stored on the credit meter;

transferring the balance on the credit meter to the player account if the request to redeem occurs before the second command; and paying the balance on the credit meter to the player via the gaming machine if the request to redeem occurs after the second command.

2. The method of claim 1 wherein providing access to the account comprises transmitting data representing the player account over the network to a local memory associated with said one gaming device.

3. The method of claim 2 wherein transferring the balance on the credit meter to the player account comprises transferring data from the credit meter to the player account in the local memory.

4. The method of game 3 wherein said method further comprises transferring the player-account data from the local memory to the central computer responsive to the second command.

5. The method of claim 4 wherein said method further comprises:

providing access to the account responsive to the first command initiated by a player at a second one of said gaming devices; and transferring the credit in the player account to a credit meter associated with the second one of said gaming devices.

6. The method of claim 5 wherein said method further includes:

initiating a timed count responsive to the second command; and preventing transfer of the credit in the player account to the credit meter associated with the second one of said gaming devices if the timed count exceeds a predetermined maximum when the player initiates the first command at the second one of said gaming devices.

7. The method of claim 4 wherein said method further comprises:

receiving a request from the player to redeem the balance stored in the account; and paying the balance to the player at a location remote from said one gaming device.

8. The method of claim 1 wherein said method further comprises preventing machine payment of the credit meter balance if the balance is above a predetermined maximum.

9. The method of claim 8 wherein said method further comprises hand paying the credit meter balance if the balance is above the maximum.

10. The method of claim 3 wherein the log-in command comprises inserting a card into a card reader associated with said one gaming device and wherein said log-out command comprises withdrawing the card.

11. The method of claim 10 wherein said method further comprises preventing initiation of said first command until a unique code is entered at a keypad associated with said one gaming device.

12. The method of claim 1 wherein said method further comprises debiting each wager from the credit meter and wherein the balance on the credit meter is less than the credit applied by the player to said one gaming device.

13. The method of claim 1 wherein the balance on the credit meter is greater than the credit applied by the player to said one gaming device.

14. The method of claim 1 wherein said method further comprises:

receiving a request from the player to redeem the balance stored in the account; and paying the balance to the player at a location remote from said one gaming device.

15. A method for transferring credits between gaming devices connected by a network to a host computer that contains a plurality of player accounts accessible at said gaming devices, said method comprising:

transmitting data representing the player account over the network to a local memory associated with said one gaming device;

transferring any balance in the account to a credit meter associated with one of said gaming devices responsive to a login command initiated by a player at said one gaming device;

storing any awards resulting from gaming device play on the credit meter;

detecting a player-initiated request to redeem the balance stored on the credit meter; and transferring the balance on the credit meter to the player account.

16. The method of claim 15 wherein transferring the balance on the credit meter to the player account comprises transferring data from the credit meter to the player account in the local memory.

17. The method of game 16 wherein said method further comprises transferring the player-account data from the local memory to the central computer responsive to a log-out command initiated by a player at said one gaming device.

18. The method of claim 15 wherein said method further includes:

detecting a log-out command initiated by a player at said one gaming device;

transferring any balance in the account to a second credit meter associated with a second one of said gaming devices responsive to a log-in command initiated by the player at said second gaming device; and storing any awards resulting from play on said second gaming device on the second credit meter.

19. The method of claim 18 wherein said method further includes:

initiating a timed count responsive to the log-out command; and preventing transfer of the balance in the account to the second credit meter if the timed count exceeds a predetermined maximum when the log-in command is initiated at said second gaming device.

20. The method of claim 15 wherein said method further includes:

detecting money paid by the player to the gaming device; and applying the money paid to the credit meter.

21. A method for paying credits on a gaming device connected by a network to a host computer that contains a plurality of player accounts accessible at said gaming devices, said method comprising:

transmitting data representing the player account over the network to a local memory associated with said one gaming device;

transferring any balance in the account to a credit meter associated with one of said gaming devices responsive to a login command at said one gaming device;

storing any awards resulting from gaming device play on the credit meter;

detecting a log-out command at said one playing device; and paying the balance on the credit meter to the player via the gaming machine.

22. The method of claim 21 wherein said method further comprises preventing machine payment of the credit meter balance if the balance is above a predetermined maximum.

23. A method for facilitating transfer of credit between gaming devices connected by a network to a host computer that contains a plurality of player accounts accessible at said gaming devices, said method comprising:

detecting a log-in command at one of said gaming devices; and transferring an initial player credit from a credit meter associated with said one gaming device to the account in response to a player-generated command at said one gaming device.

24. The method of claim 23 wherein applying an initial credit to the account in response to a player-generated command at said one gaming device includes applying a money payment to the gaming device.

25. The method of claim 23 wherein applying an initial credit to the account in response to a player-generated command at said one gaming device further comprises:

storing any awards resulting from gaming-device play on a credit meter associated with said one gaming device;

detecting a player-initiated request to redeem the balance stored on the credit meter;

detecting a log-out command at said one gaming device; and transferring the balance on the credit meter to the player account if the request occurs before the log-out command.

26. The method of claim 25 wherein said method further includes paying the balance on the credit meter to the player via the gaming machine if the request occurs after the log-out command.

27. The method of claim 1 wherein terminating access to the account responsive to a second command initiated by the player comprises terminating access to the account responsive to a second command initiated by the player at said one gaming device.

28. The method of claim 27 wherein detecting a player-initiated request to redeem the balance stored on the credit meter comprises detecting a request initiated by the player at said one gaming device to redeem the balance stored on the credit meter.

29. The method of claim 1 wherein the first command comprises a log-in command initiated by the player at said one gaming device and wherein said second command comprises a logout command initiated by the player at said one gaming device.

30. The method of claim 15 wherein transferring any balance in the account to a credit meter associated with one of said gaming devices responsive to a log-in command initiated by a player at said one gaming device comprises transferring the entire balance in the account to a credit meter associated with one of said gaming devices responsive to a log-in command initiated by a player at said one gaming device.

31. The method of claim 15 wherein the log-in command comprises inserting a card into a card reader associated with said one gaming device.

32. The method of claim 17 wherein the log-in command comprises inserting a card into a card reader associated with said one gaming device and wherein the log-out command comprises withdrawing the card.

33. The method of claim 21 wherein the log-in command comprises inserting a card into a card reader associated with said one gaming device and wherein the log-out command comprises withdrawing the card.

34. The method of claim 23 wherein the log-in command comprises inserting a card into a card reader associated with said one gaming device.

35. The method of claim 25 wherein the log-in command comprises inserting a card into a card reader associated with said one gaming device and wherein the log-out command comprises withdrawing the card.

36. The method of claim 21 wherein transferring the balance on the credit meter to the player account comprises transferring data from the credit meter to the player account in the local memory.

37. The method of game 36 wherein said method further comprises transferring the player-account data from the local memory to the central computer responsive to a log-out command initiated by a player at said one gaming device.

* * * * *

UNITED STATES PATENT AND TRADEMARK OFFICE

CERTIFICATE OF CORRECTION

PATENT NO. : 6,607,441 B1
DATED : August 19, 2003
INVENTOR(S) : Acres

It is certified that error appears in the above-identified patent and that said Letters Patent is hereby corrected as shown below:

Title page,
Item [56], References Cited, U.S. PATENT DOCUMENTS,
"5,345,379 A 9/1994 Brous et al. ……..364/140" should read -- 5,345,379 A 9/1994 Brous et al. …..364/140-147 --; and "6,116,041 A 8/2000 Walker et al. …..463/20" should read -- 6,110,041 A 8/2000 Walker et al. …....463/20 --.
FOREIGN PATENT DOCUMENTS, "EP 0805424 A2 1/1997" should read -- EP 0805424 A2 5/1997 --.

Column 7,
Line 42, "of game 3" should read -- of claim 3 --.

Column 8,
Line 39, "a login command" should read -- a log-in command --.
Line 51, "of game 16" should read -- of claim 16 --.

Column 9,
Line 22, "a login command" should read -- a log-in command --.

Column 10,
Line 20, "a logout command" should read -- a log-out command --.

Signed and Sealed this

Sixth Day of July, 2004

JON W. DUDAS
*Acting Director of the United States Patent and Trademark Office*